US005730762A

United States Patent [19]

Murakami et al.

[11] Patent Number: 5,730,762

[45] Date of Patent: Mar. 24, 1998

[54] GAS OIL (LAW451)

[75] Inventors: Kazuyuki Murakami; Shoukichi Yamamoto; Yutaka Hasegawa; Kazushi Tsurutani, all of Saitama-Ken, Japan

[73] Assignee: Exxon Research and Engineering Company, Florham Park, N.J.

[21] Appl. No.: 690,445

[22] Filed: Jul. 26, 1996

[30] Foreign Application Priority Data

| | | | |
|---|---|---|---|
| Jul. 31, 1995 | [JP] | Japan | 7-194438 |
| Jul. 31, 1995 | [JP] | Japan | 7-194440 |
| Jul. 31, 1995 | [JP] | Japan | 7-194502 |

[51] Int. Cl.[6] ..... C10L 1/22

[52] U.S. Cl. ..... 44/329; 208/15; 585/14

[58] Field of Search ..... 585/14; 208/15; 44/329, 333, 334, 340, 330, 331, 335, 336, 342, 343

[56] References Cited

U.S. PATENT DOCUMENTS

| | | | |
|---|---|---|---|
| 4,632,674 | 12/1986 | Martella . | |
| 4,846,959 | 7/1989 | Kennedy et al. | 208/97 |
| 5,316,658 | 5/1994 | Ushio | 208/216 R |
| 5,389,111 | 2/1995 | Nikanjam | 585/14 |
| 5,405,417 | 4/1995 | Cunningham | 44/322 |
| 5,482,521 | 1/1996 | Avery et al. | 44/344 |
| 5,484,462 | 1/1996 | Herbstman | 44/334 |

FOREIGN PATENT DOCUMENTS

| | | | |
|---|---|---|---|
| 0487255 | 5/1992 | European Pat. Off. | C10L 10/06 |
| 4240582 | 6/1994 | Germany | C10L 1/16 |
| 92/04385 | 3/1992 | WIPO | C08F 8/30 |
| 94/20593 | 9/1994 | WIPO | C10L 1/22 |

*Primary Examiner*—Prince Willis, Jr.
*Assistant Examiner*—Cephia D. Toomer
*Attorney, Agent, or Firm*—Joseph J. Allocca

[57] ABSTRACT

A gas oil according to the present invention comprises a gas oil fraction, and has a sulfur content not higher than 0.05 wt %, and either or both of (1) a content of bicyclic and higher aromatic hydrocarbons in a range of from 3.5 wt % to 15 wt %, bicyclic and higher aromatic hydrocarbons having at least one side-chain $C_{3-11}$ alkyl group amounting to at least 80 wt % of said first-mentioned bicyclic and higher aromatic hydrocarbons, and (2) a content of nitrogen-containing heterocyclic compounds in a range of from 80 ppm to 500 ppm, nitrogen-containing heterocyclic compounds having at least one side-chain alkyl group accounting for at least 90 wt % of said first-mentioned nitrogen-containing heterocyclic compounds. The gas oil according to the present invention, as a diesel fuel, can impart anti-wearing properties by simply adjusting its components without the need for incorporation of an additive such as an anti-wearing agent. It does not cause wearing of a fuel injection pump, has excellent storage stability and can be furnished as an economical gas oil. It can also be furnished as a gas oil suited for use especially in cold districts.

8 Claims, No Drawings

GAS OIL (LAW451)

FIELD OF THE INVENTION

The present invention relates to a gas oil, which has a low sulfur content and excellent lubricity and is suited for use especially in cold districts.

Diesel engines have better gas mileage and lower fuel cost and are more durable than gasoline engines, so that they are mounted on trucks, buses, watercraft, construction machinery and the like. Keeping step with changes in the social environment, diesel engines tend to increase year by year.

However, sulfur contained in gas oil (diesel fuel) has induced very serious social problems and at the meeting of the Central Council for Environmental Pollution Control held in December, 1989, it was advised that as a short-term target the sulfur content of gas oil be reduced to 0.2 wt % or lower in 1992 and in the long run to cut it down further to 0.05 wt % or lower by 1998. A reduction in the sulfur content of gas oil is therefore a theme which requires urgent attention.

A reduction in the sulfur content of gas oil is generally achieved by purification, especially catalytic hydrogenation. A reduction in the sulfur content of gas oil however leads to a reduction in the lubricity of gas oil itself, thereby developing the problem that an injection system of a diesel engine may be damaged. Especially, a sulfur content of 0.2 wt % or lower causes wearing of an injection pump (in particular, a rotary pump and a pump injector) and the extent of its wearing increases in proportion to the reduction in the sulfur content. It is therefore known for an anti-wearing agent to be added, for example, a fatty acid ester or the like. Problems associated with gas oil added with such an additive however include high price and poor storage stability.

An object of the present invention is therefore to provide a gas oil having excellent anti-wearing properties by specifying properties of a gas oil fraction without the need for addition of an anti-wearing agent.

DESCRIPTION OF THE INVENTION

The present invention therefore provides a gas oil comprising a gas oil fraction and having a sulfur content not higher than 0.05 wt %, and either or both of (1) a content of bicyclic and higher aromatic hydrocarbons (hereinafter called "polycyclic aromatic hydrocarbons") in a range of from 3.5 wt % to 15 wt %, bicyclic and higher aromatic hydrocarbons having at least one side-chain $C_{3-11}$ alkyl group (hereinafter called "long-chain-alkyl-substituted polycyclic aromatic hydrocarbons") amounting to at least 80 wt % of said first-mentioned bicyclic and higher aromatic hydrocarbons, and (2) a content of nitrogen-containing heterocyclic compounds in a range of from 80 ppm to 500 ppm, nitrogen-containing heterocyclic compounds having at least one side-chain alkyl group accounting for at least 90 wt % of said first-mentioned nitrogen-containing heterocyclic compounds.

The gas oil according to the present invention comprises a gas oil fraction which has been obtained by subjecting crude oil, especially a paraffin or mixed-base crude oil, to atmospheric distillation and then purifying the resultant distillate by hydrogenation. It has distillation properties of 330° C. or lower in terms of 90% distillation temperature (boiling points and distillation temperatures are those measured according to JIS K 2254) and satisfies the standard for gas oil specified in JIS K 2204.

The gas oil according to the present invention satisfies these standards and its sulfur content has been reduced to 0.05 wt % or lower. Further, it contains either or both of (1) specific aromatic hydrocarbon components and (2) particular nitrogen-containing heterocyclic compound components in the prescribed amounts, respectively.

The aromatic hydrocarbon content of gas oil after hydrogenation is generally in a range of from 20 wt % to 30 wt % although it varies depending on the extent of the hydrogenation. It can be broken down into 12 wt % to 27 wt % of monocyclic compounds and 2 wt % to 15 wt % of polycyclic compounds. In the gas oil according to the present invention, the content of polycyclic aromatic hydrocarbons in the gas oil is limited to 3.5 wt % to 15 wt %, preferably 3.5 wt % to 10 wt %. A content of polycyclic aromatic hydrocarbons higher than 15 wt % will lead to exhaust gas containing more particulates and is not preferred. On the other hand, a content of polycyclic aromatic hydrocarbons lower than 3.5 wt % will result in a gas oil having inferior anti-wearing properties.

Concerning the distribution of aromatic hydrocarbons as broken down depending on the carbon numbers of their substituent akyl groups, a distribution substantially in the form of a normal distribution curve is drawn with those having one or more side-chain $C_{5-7}$ alkyl groups forming a peak (their proportion ranging from 35 wt % to 50 wt %). Those having one or more $C_{1-2}$ substituent alkyl groups approximately account for 5 wt % to 15 wt %. Further, those having one or more $C_{12}$ or higher alkyl groups are practically not found in ordinary gas oil.

In the gas oil according to the present invention, the preferred number of carbon atoms in each side-chain alkyl group ranges from 3 to 11. A carbon number smaller than 3 is not effective for lubricity, while a carbon number greater than 11 leads to thermal instability.

Polycyclic aromatic compounds contain those having one or more $C_{3-11}$ alkyl groups in a proportion of 80 wt % or higher, preferably 90 wt % or higher. Owing to this feature, the gas oil can exhibit superb lubricity despite it having a sulfur content as low as 0.05 wt % or less.

Although detailed reasons have not been elucidated yet, a monocyclic aromatic hydrocarbon is presumed to give no significant contribution to the lubricity of a gas oil even if it contains one or more alkyl groups as substituent groups because the van der Waals force of the aromatic ring is so small that no substantial interaction takes place between molecules under high load. On the other hand, polycyclic aromatic hydrocarbons containing 80 wt % or more of long-chain-alkyl-substituted polycyclic aromatic hydrocarbons are believed to have strong interaction between molecules under high load and hence to show high viscosity owing to tangling of molecules, thereby presumably showing excellent lubricity. Further, the lubricity is presumed to be affected by the length of side-chain substituent groups rather than the number thereof.

The content of polycyclic aromatic hydrocarbons in a gas oil and the distribution thereof as broken down depending on their carbon numbers can be determined by providing 5 g of the gas oil as a sample, extracting its saturated components with n-hexane, subjecting the residue to column-chromatographic separation [chromatographic column: 25 mmf×900 mm, chromatographic gel: 200 g (40 g/gram of sample) of silica gel ("#12", product of Fuji Silysia Chemical Ltd.), solvent: 600 ml (3 ml/gram of gel) of toluene] and then subjecting the thus-obtained aromatic components to mass spectrometry, by the fragment ionization method.

A description will next be made about the nitrogen-containing heterocyclic compounds.

Concerning the total content of nitrogen-containing heterocyclic compounds in general gas oil, it ranges from 20 ppm to 500 ppm in a gas oil fraction obtained in a straight ran. After hydrogenation, however, it is generally decreased to 10 ppm to 200 ppm although it varies depending on the extent of the hydrogenation. Nitrogen-containing heterocyclic compounds contained in such a gas oil are mostly carbazole compounds but also include indole compounds in trace proportions. Further, side-chain alkyl groups are those containing 0 to 4 carbon atoms and those containing 5 or more carbon atoms are practically not found in gas oil. In general, side-chain alkyl groups having 1 to 3 carbon atoms are predominant.

In the gas oil according to the present invention, the sulfur content has been reduced to 0.05 wt % or lower and the content of nitrogen-containing heterocyclic compounds has been controlled to 80 ppm to 500 ppm, preferably 100 ppm to 500 ppm. A content of nitrogen-containing heterocyclic compounds greater than 500 ppm will lead to reduced low-temperature fluidity and is not preferred. On the other hand, a content smaller than 80 ppm will result in inferior anti-wearing properties.

Further, as nitrogen-containing heterocyclic compounds, those containing one or more alkyl groups as side-chain substituent groups are preferred. It is also preferred that nitrogen-containing heterocyclic compounds containing one or more side-chain alkyl groups as substituents account for 90 wt % or more of all the nitrogen-containing heterocyclic compounds present. This feature can provide excellent lubricity despite the sulfur content being as low as 0.05 wt % or less.

Although detailed reasons for this advantage have not been fully elucidated yet, it is presumed that a nitrogen-containing heterocyclic compound having no substituent group does not contribute to the lubricity of a gas oil but a nitrogen-containing heterocyclic compound having one or more alkyl groups as side-chain substituent groups exhibits oiliness owing to adsorption of a nitrogen atom in the molecule on a metal surface and shows excellent lubricity owing to interaction of the substituent alkyl groups.

The content of nitrogen-containing heterocyclic compounds in a gas oil and the distribution thereof as broken down depending on their carbon numbers can be determined by providing 5 g of the gas off as a sample, extracting its saturated components with n-hexane and its aromatic hydrocarbon components with toluene, subjecting the residue to column-chromatographic separation [chromatographic column: 25 mmf×900 mm, chromatographic gel: 200 g (40 g/gram of sample) of silica gel ("#12", product of Fuji Silysia Chemical Ltd.), solvent: 600 ml (3 ml/gram of gel) of methanol] and then subjecting the thus-obtained polar components to mass spectrometry (by the fragment ionization method).

The followings are the compositions of illustrative gas oils obtained by hydrogenation and desulfurization:

| | |
|---|---|
| (1) | |
| Sulfur content | 0.03 wt % |
| Polycyclic aromatic hydrocarbon content | 1.0 wt % |
| Bicyclic aromatic hydrocarbon content | 2.9 wt % |
| Percentage of long-chain-alkyl-substituted polycyclic aromatic hydrocarbons in polycyclic aromatic hydrocarbons | 86 wt % |
| Content of nitrogen-containing heterocyclic compounds | 11 ppm |
| Percentage of nitrogen-containing heterocyclic compounds containing one or more alkyl groups as side chains in nitrogen-containing heterocyclic compounds | 92 wt % |
| (2) | |
| Sulfur content | 0.03 wt % |
| Polycyclic aromatic hydrocarbon content | 1.3 wt % |
| Bicyclic aromatic hydrocarbon content | 1.5 wt % |
| Percentage of long-chain-alkyl-substituted polycyclic aromatic hydrocarbons in polycyclic aromatic hydrocarbons | 72 wt % |
| Content of nitrogen-containing heterocyclic compounds | 20 ppm |
| Percentage of nitrogen-containing heterocyclic compounds containing one or more alkyl groups as side chains in nitrogen-containing heterocyclic compounds | 82 wt % |
| (3) | |
| Sulfur content | 0.2 wt % |
| Polycyclic aromatic hydrocarbon content (including bicyclic aromatic hydrocarbon content) | 3.5 wt % |
| Bicyclic aromatic hydrocarbon content | 2.9 wt % |
| Percentage of long-chain-alkyl-substituted polycyclic aromatic hydrocarbons in polycyclic aromatic hydrocarbons | 60 wt % |
| (4) | |
| Sulfur content | 0.01 wt % |
| Polycyclic aromatic hydrocarbon content (including bicyclic aromatic hydrocarbon content) | 1.7 wt % |
| Bicyclic aromatic hydrocarbon content | 1.5 wt % |
| Percentage of long-chain-alkyl-substituted polycyclic aromatic hydrocarbons in polycyclic aromatic hydrocarbons | 75 wt % |
| (5) | |
| Sulfur content | 0.01 wt % |
| Content of nitrogen-containing heterocyclic compounds | 14 ppm |
| Percentage of nitrogen-containing heterocyclic compounds containing one or more alkyl groups as side chains in nitrogen-containing heterocyclic compounds | 88 wt % |
| (6) | |
| Sulfur content | 0.05 wt % |
| Content of nitrogen-containing heterocyclic compounds | 60 ppm |
| Percentage of nitrogen-containing heterocyclic compounds containing one or more alkyl groups as side chains in nitrogen-containing heterocyclic compounds | 93 wt % |

The gas oil according to the present invention can be prepared, for example, by blending gas oils—which have a high aromatic hydrocarbon content and contain nitrogen-containing heterocyclic compounds in a large amount, respectively—to a hydrogenated and desulfurized gas oil as needed. As a gas oil rich in aromatic components, it is possible to use, for example, a catalytically-cracked gas oil which has been obtained by subjecting heavy oil, a straight run fraction of crude oil, to catalytic cracking.

Further, the gas oil according to the present invention can be added with a pour-point lowering agent, a cetane number improving agent and the like as needed.

The gas oil according to the present invention can impart anti-wearing properties owing only to the adjustment of its components without the need for incorporation of an additive such as an anti-wearing agent. It is an economical fuel oil having excellent storage stability and can be provided as a gas oil suited for use especially in cold districts.

EXAMPLES

A description will next be made about a wear test which was adopted in Examples.

The wear test adopted in the present invention is specified under ISO/TC 22/SC7 N595. Using high frequency reciprocating rig equipment ("HFRR", manufactured by PCS Company), the test is conducted under the below-described test conditions to measure a wear scar diameter (μm). According to this measuring method, a gas oil excellent in anti-wearing properties results in a smaller wear scar diameter but conversely, a gas oil inferior in anti-wearing properties leads to a greater wear scar diameter.

| | |
|---|---|
| Oil volume | 1 ± 0.20 ml |
| Stroke length | 1 ± 0.02 mm |
| Frequency | 50 ± 1 Hz |
| Oil temperature | 25 ± 2° C., or 60 ± 2° C. |
| Load | 200 g |
| Testing time | 75 ± 0.1 minutes |
| Oil surface area | 6 ± 1 $cm^2$ |

Example 1

A gas oil fraction having the properties and composition shown in Table 1 was obtained as Sample Oil 1, which was a fuel oil according to the present invention, by mixing a gas oil base material having high aromatic properties with a gas oil fraction obtained by atmospheric distillation of crude oil and desulfurized to a sulfur content of 0.05 wt %.

Example 2

A gas oil fraction having the properties and composition shown in Table 1 was obtained as Sample Oil 2, which was a fuel oil according to the present invention, by adjusting the aromatic components of a gas oil fraction, which had been obtained by atmospheric distillation of crude oil and desulfurized to a sulfur content of 0.05 wt %, as in Example 1.

Example 3

A gas oil fraction having the properties and composition shown in Table 1 was obtained as Sample Oil 3, which was a fuel oil according to the present invention, by adding isopropylnaphthalene and di-tert-butylnaphthalene to Comparative Oil 1, which had been obtained by atmospheric distillation of crude oil, desulfurized to a sulfur content of 0.01 wt % and shown below in Table, 1, so that the contents of isopropylnaphthalene and di-tert-butylnaphthalene became 0.8 wt % and 1.0 wt %, respectively.

Comparative Example 1

A gas oil shown below in Table 1 was provided as Comparative Oil 1.

Comparative Example 2

Prepared as Comparative Oil 2 was a gas oil fraction obtained by atmospheric distillation of crude oil, desulfurized to a sulfur content of 0.2 wt % and having the properlies and composition shown in Table 1.

Sample Oils 1 to 3 and Comparative Oils 1 to 2, which had been prepared as described above were subjected to a wear test at 60° C. The results are also shown below in Table 1.

TABLE 1

| | Examples | | | Comparative Examples | |
|---|---|---|---|---|---|
| | 1 | 2 | 3 | 1 | 2 |
| Density (g/cm) | 0.83 | 0.82 | 0.82 | 0.82 | 0.82 |
| Cetane index | 60 | 63 | 63 | 67 | 63 |
| Viscosity (30° C., mm/s) | 3.64 | 3.44 | 3.40 | 3.37 | 3.51 |
| Sulfur content (wt %) | 0.05 | 0.05 | 0.01 | 0.01 | 0.2 |
| IBP (°C.) | 176 | 157 | 153 | 153 | 157 |
| T20(°C.) | 240 | 233 | 232 | 232 | 239 |
| T50(°C.) | 278 | 275 | 276 | 274 | 277 |
| T90(°C.) | 327 | 326 | 330 | 324 | 326 |
| Content of polycyclic aromatic hydrocarbons (wt %) | 8.4 | 3.6 | 3.5 | 1.7 | 3.5 |
| Ratio of polycyclic aromatic hydrocarbons with long-chain alkyl substituents to polycyclic aromatic hydrocarbons (wt %) | 90 | 85 | 93 | 75 | 60 |
| HFRR value (μm) as wear tests result | 420 | 440 | 430 | 620 | 580 |

As is appreciated from the table, the fuel oils according to the present invention are excellent in anti-wearing properties.

Example 4

A fuel oil having the properties and composition shown in Table 2 was obtained as Sample Oil 4 according to the present invention by mixing a gas oil base material, which contained nitrogen-containing heterocyclic compounds in a large amount, with a gas oil fraction obtained by atmospheric distillation of crude oil and desulfurized to a sulfur content of 0.05 wt % and hence adjusting the content of the nitrogen-containing heterocyclic compounds.

Example 5

A fuel oil having the properties and composition shown in Table 2 was obtained as Sample Oil 5 according to the present invention by adjusting the content of nitrogen-containing heterocyclic compounds in a gas oil fraction, which had been obtained by atmospheric distillation of crude oil and desulfurized to a sulfur content of 0.05 wt %, as in Example 4.

Example 6

A fuel oil having the properties and composition shown in Table 2 was obtained as Sample Oil 6 according to the present invention by adding methylcarbazole and ethylcarbazole to Comparative Oil 3, which had been obtained by atmospheric distillation of crude oil, desulfurized to a sulfar content of 0.01 wt % and shown below in Table 2, so that the contents of methylcarbazole and ethylcarbazole became 26 ppm and 40 ppm, respectively.

Comparative Example 3

Prepared as Comparative Oil 3 was the gas oil which was a gas oil fraction obtained by atmospheric distillation of crude oil and desulfurized to a sulfur content of 0.01 wt % and which had the properties and composition shown in Table 2.

Comparative Example 4

Prepared as Comparative Oil 4 was a gas oil fraction obtained by atmospheric distillation of crude oil, desulfurized to a sulfur content of 0.2 wt % and having the properties and composition shown in Table 2.

Sample Oils 4 to 6 and Comparative Oils 3 to 4, which had been prepared as described above were subjected to a wear test at 60° C. The results are also shown below in Table 2.

TABLE 2

| | Examples | | | Comparative Examples | |
|---|---|---|---|---|---|
| | 4 | 5 | 6 | 3 | 4 |
| Density (g/cm) | 0.83 | 0.82 | 0.83 | 0.82 | 0.82 |
| Cetane index | 60 | 63 | 64 | 67 | 63 |
| Viscosity (30° C., mm/s) | 3.64 | 3.44 | 3.40 | 3.37 | 3.51 |
| Sulfur content (wt %) | 0.05 | 0.05 | 0.01 | 0.01 | 0.2 |
| IBP (°C.) | 176 | 157 | 153 | 153 | 157 |
| T20(°C.) | 240 | 233 | 232 | 232 | 239 |
| T50(°C.) | 278 | 275 | 276 | 274 | 277 |
| T90(°C.) | 327 | 326 | 330 | 324 | 326 |
| Content of nitrogen containing heterocyclic compounds (ppm) | 116 | 84 | 80 | 14 | 60 |
| Ratio of nitrogen-containing heterocyclic compounds with side chain alkyl substituents to nitrogen-containing heterocyclic compounds (wt %) | 93 | 94 | 94 | 88 | 93 |
| HFRR value (μm) as wear tests result | 420 | 440 | 430 | 620 | 580 |

As is appreciated from the table, the fuel oils according to the present invention are excellent in anti-wearing properties.

Example 7

A fuel oil having the properties and composition shown in Table 3 was prepared as Sample Oil 7 according to the present invention by mixing a gas oil base material, which had high aromatic properties and contained nitrogen-containing heterocyclic compounds in a large amount, with a gas oil fraction obtained by atmospheric distillation of crude oil and desulfurized to a sulfur content of 0.4 wt % and hence adjusting the aromatic hydrocarbon components and nitrogen-containing heterocyclic compound components.

Example 8

A fuel oil having the properties and composition shown in Table 3 was prepared as Sample Oil 8 according to the present invention by adjusting the aromatic hydrocarbon components and nitrogen-containing heterocyclic compound components in a gas oil fraction, which had been obtained by atmospheric distillation of crude oil and desulfurized to a sulfur content of 0.01 wt %, as in Example 7.

Comparative Example 5

Prepared as Comparative Oil 5 was a gas oil which was a gas oil fraction obtained by atmospheric distillation of crude oil and desulfurized to a sulfur content of 0.03 wt % and which had the properties and composition shown in Table 3.

Comparative Example 6

Prepared as Comparative Oil 6 was a gas oil fraction obtained by atmospheric distillation of crude oil, desulfurized to a sulfur content of 0.03 wt % and having the properties and composition shown in Table 3.

The Sample Oils 7 to 8 and Comparative Oils 5 to 6, which had been prepared as described above were subjected to a wear test at 60° C. The results are also shown below in Table 3.

TABLE 3

| | Examples | | Comparative Examples | |
|---|---|---|---|---|
| | 7 | 8 | 5 | 6 |
| Density (g/cm) | 0.81 | 0.81 | 0.80 | 0.80 |
| Cetane index | 53 | 52 | 55 | 55 |
| Viscosity (30° C., mm/s) | 1.81 | 1.82 | 1.74 | 1.74 |
| Sulfur content (wt %) | 0.04 | 0.01 | 0.03 | 0.03 |
| IBP (°C.) | 139 | 140 | 140 | 141 |
| T20(°C.) | 188 | 184 | 186 | 187 |
| T50(°C.) | 216 | 214 | 213 | 213 |
| T90(°C.) | 289 | 290 | 279 | 277 |
| Content of polycyclic aromatic hydrocarbons (wt %) | 5.0 | 4.0 | 1.0 | 1.3 |
| Ratio of polycyclic aromatic hydrocarbons with long-chain alkyl substituents to polycyclic aromatic hydrocarbons (wt %) | 85 | 90 | 86 | 72 |
| Content of nitrogen-containing heterocyclic compounds (ppm) | 83 | 122 | 11 | 20 |
| Ratio of nitrogen-containing heterocyclic compounds with side chain alkyl substituents to nitrogen-containing heterocyclic compounds (wt %) | 91 | 95 | 92 | 82 |
| HFRR value (μm) as wear tests result | 410 | 430 | 610 | 590 |

What is claimed is:

1. A gas oil comprising a gas oil fraction and having a sulfur content not higher than 0.05 wt %, and either or both of (1) a content of bicyclic and polycyclic aromatic hydrocarbons in a range of from 3.5 wt % to 15 wt %, bicyclic and polycyclic aromatic hydrocarbons having at least one side-chain $C_{3-11}$ alkyl group amounting to at least 80 wt % of said first-mentioned bicyclic and polycyclic aromatic hydrocarbons, and (2) a content of nitrogen-containing heterocyclic aromatic compounds in a range of from 80 ppm to 500 ppm, wherein said nitrogen-containing heterocyclic aromatic compounds are selected from the group consisting of carbazole compounds, indole compounds and mixtures thereof.

2. The gas oil according to claim 1 comprising a gas oil fraction and having a sulfur content not higher than 0.05 wt % and a content of nitrogen-containing heterocyclic aromatic compounds in a range of from 80 ppm to 500 ppm, wherein said nitrogen-containing heterocyclic aromatic compounds are selected from the group consisting of carbazole compounds, indole compounds and mixtures thereof.

3. The gas oil, according to claim 1 comprising a gas oil fraction and having a sulfur content not higher than 0.05 wt % and a content of bicyclic and polycyclic aromatic hydrocarbons in a range of from 3.5 wt % to 15 wt %, bicyclic and polycyclic aromatic hydrocarbons having at least one side-chain $C_{3-11}$ alkyl group amounting to at least 80 wt % of said first-mentioned bicyclic and polycyclic aromatic hydrocarbons.

4. The gas oil according to claim 1 comprising a gas oil fraction and having a sulfur content not higher than 0.05 wt %, a content of bicyclic and polycyclic aromatic hydrocarbons in a range of from 3.5 wt % to 15 wt %, bicyclic and polycyclic aromatic hydrocarbons having at least one side-chain $C_{3-11}$ alkyl group amounting to at least 80 wt % of said first-mentioned bicyclic and polycyclic aromatic hydrocarbons, and a content of nitrogen-containing heterocyclic aromatic compounds in a range of from 80 ppm to 500 ppm, wherein said nitrogen-containing heterocyclic aromatic compounds are selected from the group consisting of carbazole compounds, indole compounds and mixtures thereof.

5. The gas oil of claim 1, 3 or 4 wherein the content of bicyclic and polycyclic aromatic hydrocarbon is in the range of from 3.5 to 10 wt %.

6. The gas oil of claim 1, 3 or 4 wherein the bicyclic and polycyclic aromatic hydrocarbons having at least one side chain $C_3$–$C_{11}$ alkyl group amount to 90 wt % or higher of the bicyclic and polycyclic aromatic hydrocarbons present.

7. The gas oil of claim 1, 2 or 4 wherein the content of nitrogen containing heterocyclic aromatic compounds is in the range of 100 ppm to 500 ppm.

8. The gas oil of claim 1, 2 or 4 wherein nitrogen containing heterocyclic aromatic compounds selected from the group consisting of carbazole compounds, indole compounds and mixtures thereof having at least one side chain alkyl group account for at least 90 wt % of the nitrogen-containing heterocyclic aromatic compounds present.

* * * * *